US008531476B1

(12) United States Patent
Jiang et al.

(10) Patent No.: US 8,531,476 B1
(45) Date of Patent: Sep. 10, 2013

(54) ENHANCED MONOCHROMATIC DISPLAY

(75) Inventors: Simon Jiang, Allen, TX (US); Raymond Page, Georgetown, TX (US)

(73) Assignee: ARMSTEL Holding, LLC, Allen, TX (US)

( * ) Notice: Subject to any disclaimer, the term of this patent is extended or adjusted under 35 U.S.C. 154(b) by 577 days.

(21) Appl. No.: 12/877,095

(22) Filed: Sep. 7, 2010

(51) Int. Cl.
*G09G 5/02* (2006.01)

(52) U.S. Cl.
USPC ..... 345/605

(58) Field of Classification Search
USPC ..... 345/589–605
See application file for complete search history.

(56) References Cited

U.S. PATENT DOCUMENTS 7,643,040 B1 * 1/2010 Gabrielson et al. ..... 345/690
2007/0055143 A1 3/2007 Deroo et al.
2007/0067124 A1 3/2007 Kimpe et al.
2007/0211085 A1 9/2007 Galant
2009/0251483 A1 * 10/2009 Hsu et al. ..... 345/589
2010/0060660 A1 * 3/2010 Bae et al. ..... 345/596

* cited by examiner

*Primary Examiner* — Aaron M Richer
*Assistant Examiner* — Mohammad H Akhavannik
(74) *Attorney, Agent, or Firm* — Haynes and Boone, LLP

(57) ABSTRACT

A method includes receiving a desired output shade of a pixel for display to a user. The pixel has a first, second, and third sub-pixel, each of which have associated a luminosity, a plurality of private color bits, and a plurality of common color bits. The method selects a plurality of intermediate shades based on the desired output shade and maps the plurality of intermediate shades to a plurality of frame colors, including a first and second frame color. The method sets a first display frame, setting the luminosity, private color bits, and common color bits of each sub-pixel based on the first frame color. The method sets a second display frame, setting the luminosity, private color bits, and common color bits of each sub-pixel based on the second frame color. The method includes sending a first and second display signal to an output device, the first display signal being based on the first display frame, and the second display signal being based on the second display frame. The output device displays the pixel to the user based on the first display signal and the second display signal.

16 Claims, 6 Drawing Sheets

ENHANCED MONOCHROMATIC DISPLAY

TECHNICAL FIELD

The present invention relates generally to the field of human information display and, more particularly, to systems and methods for displaying monochromatic pixel arrays to human users.

BACKGROUND

Modern human society includes a wide variety of environments in which humans must process large amounts of complex information, often under time-sensitive deadlines. Various mechanisms have been developed to collect, synthesize, and convey complex information to humans in a manner that facilitates communication and understanding. For example, color-coding and/or shading have long been an effective mechanism to convey information to improve understanding.

Additionally, certain technological advances have naturally developed shading techniques as an organic aspect of the technology. For example, x-ray images inherently include gradations of shade, which skilled technicians use to gather information relating to medical conditions, material composition, internal construction, and a wide variety of other purposes.

Advances in display technology have allowed for applications that can process x-ray images (and other analog images) as digital images. Such images are often processed as a monochromatic image. However, current display devices that can process these images with the appropriate clarity and precision are often cost-prohibitive. Similarly, common cost-effective display equipment cannot display the number of different monochrome shades necessary to support the proper resolution of the image.

BRIEF SUMMARY

The following summary is provided to facilitate an understanding of some of the innovative features unique to the embodiments disclosed and is not intended to be a full description. A full appreciation of the various aspects of the embodiments can be gained by taking into consideration the entire specification, claims, drawings, and abstract as a whole.

In a general aspect of the invention, a method for generating a desired output shade in a pixel for display to a user includes receiving a desired output shade of a pixel for display to a user. The pixel has a first sub-pixel, a second sub-pixel, and a third sub-pixel. Each of the first sub-pixel, second sub-pixel, and third sub-pixel have associated a luminosity, a plurality of private color bits, and a plurality of common color bits. The method includes selecting a plurality of intermediate shades based on the desired output shade. The method includes mapping the plurality of intermediate shades to a plurality of frame colors, the plurality of frame colors including a first frame color and a second frame color. The method includes setting a first display frame, wherein setting the first display frame comprises setting the luminosity, private color bits, and common color bits of each of the first sub-pixel, second sub-pixel, and third sub-pixel based on the first frame color. The method includes setting a second display frame, wherein setting the second display frame comprises setting the luminosity, private color bits, and common color bits of each of the first sub-pixel, second sub-pixel, and third sub-pixel based on the second frame color. The method includes sending a first display signal to an output device, the first display signal being based on the first display frame, and the output device being able to display the pixel to the user based on the first display signal. And the method includes sending a second display signal to an output device, the second display signal being based on the second display frame, and the output device being able to display the pixel to the user based on the second display signal.

In a preferred embodiment, the desired output shade comprises a plurality of select bits; and mapping the plurality of intermediate shades to a plurality of frame colors includes selecting between a first frame color and a second frame color based at least one of on the plurality select bits. In another preferred embodiment, the desired output shade comprises a plurality of shade bits and a select bit; and setting the luminosity, private color bit, and common color bits of each of the first sub-pixel, second sub-pixel, and third sub-pixel based on the first frame color comprises setting the common color bits of the first sub-pixel, second sub-pixel, and third sub-pixel to a first value, based on the plurality of shade bits and the select bit; independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

In another preferred embodiment, setting the luminosity, private color bit, and common color bits of each of the first sub-pixel, second sub-pixel, and third sub-pixel based on the second frame color comprises setting the common color bits of the first sub-pixel, second sub-pixel, and third sub-pixel to a second value, based on the plurality of shade bits and the select bit; independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

In another preferred embodiment, wherein the desired output shade is a monochromatic shade. In another preferred embodiment, the output device is an 8-bit-per-channel Red/Blue/Greed color monitor. In another preferred embodiment, each of the plurality of common color bits comprise 7 bits and each of the plurality of private color bits comprise 1 bit. In another preferred embodiment, the output device is an 8-bit-per-channel Red/Blue/Greed color monitor and the desired output shade comprises 11 bits.

In another preferred embodiment, the desired output shade is one of a plurality of output shades, the plurality of output shades including at least 1024 monochromatic output shades.

In another general aspect of the invention, a system for generating a desired output shade in a pixel for display to a user includes a grayscale engine able to receive a desired monochromatic output shade of a pixel for display to a user. The pixel has a first sub-pixel, a second sub-pixel, and a third sub-pixel. Each of the first sub-pixel, second sub-pixel, and third sub-pixel have associated a luminosity, a plurality of private color bits, and a plurality of common color bits. The grayscale engine is further able to select a plurality of intermediate shades based on the desired output monochromatic shade and to map the plurality of intermediate shades to a plurality of frame colors, the plurality of frame colors including a first frame color and a second frame color. The grayscale engine is further able to set a first display frame, wherein setting the first display frame comprises setting the luminosity, private color bits, and common color bits of each of the first sub-pixel, second sub-pixel, and third sub-pixel based on the first frame color. The grayscale engine is further able to set a second display frame, wherein setting the second display frame comprises setting the luminosity, private color bits, and common color bits of each of the first sub-pixel, second sub-pixel, and third sub-pixel based on the second frame color. An output device couples to the grayscale engine and is able to display the pixel to the user based on the first display frame and the second display frame.

In a preferred embodiment, the desired output shade comprises a plurality of select bits and mapping the plurality of intermediate shades to a plurality of frame colors includes selecting between a first frame color and a second frame color based at least one of on the plurality select bits. In another preferred embodiment, the desired monochromatic output shade comprises a plurality of shade bits and a select bit. Setting the luminosity, private color bit, and common color bits of each of the first sub-pixel, second sub-pixel, and third sub-pixel based on the first frame color comprises: setting the common color bits of the first sub-pixel, second sub-pixel, and third sub-pixel to a first value, based on the plurality of shade bits and the select bit; independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

In another preferred embodiment, setting the luminosity, private color bit, and common color bits of each of the first sub-pixel, second sub-pixel, and third sub-pixel based on the second frame color comprises: setting the common color bits of the first sub-pixel, second sub-pixel, and third sub-pixel to a second value, based on the plurality of shade bits and the select bit; independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

In another preferred embodiment, the desired monochromatic output shade is a grayscale shade. In another preferred embodiment, the desired output shade is one of a plurality of output shades, the plurality of output shades including at least 1024 output shades.

In still another general aspect of the invention, a device for displaying color and monochrome images to a user includes an adaptor able to receive an input signal. The adaptor is further able to determine whether the received input signal is an enhanced monochromatic signal. The adaptor is further able to transmit a received enhanced monochromatic signal to a grayscale engine. The received monochromatic signal has a plurality of shade bits and a plurality of select bits. The grayscale engine is able to: decode the plurality of shade bits and the plurality of select bits to select an intermediate shade of a plurality of intermediate shades; set a plurality of sub-pixel common color bits of a pixel based on the selected intermediate shade; set a plurality of private color bits of the pixel based on the selected intermediate shade; set a plurality of luminosities of the pixel based on the selected intermediate shade; and communicate the plurality of sub-pixel common color bits, private color bits, and luminosities of the pixel to an output device. The output device couples to the grayscale engine and is able to display the pixel to a user based on the sub-pixel common color bits, private color bits, and luminosities.

In a preferred embodiment, the output device is an 8-bit-per-channel Red/Blue/Greed color monitor. In another preferred embodiment, each of the plurality of sub-pixel common color bits comprise 7 bits and each of the plurality of private color bits comprise 1 bit.

In another preferred embodiment, the output device is an 8-bit-per-channel Red/Blue/Greed color monitor and the desired output shade comprises 11 bits. In another preferred embodiment, the desired output shade is one of a plurality of output shades, the plurality of output shades including at least 1024 output shades.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope of the invention. In the following discussion, numerous specific details are set forth to provide a thorough understanding of the present invention. Those skilled in the art will appreciate that the present invention may be practiced without such specific details. In other instances, well-known elements have been illustrated in schematic or block diagram form in order not to obscure the present invention in unnecessary detail. Additionally, for the most part, details concerning network communications, electro-magnetic signaling techniques, user interface or input/output techniques, and the like, have been omitted inasmuch as such details are not considered necessary to obtain a complete understanding of the present invention, and are considered to be within the understanding of persons of ordinary skill in the relevant art.

As will be appreciated by one skilled in the art, the present invention may be embodied as a system, method, or computer program product. Accordingly, the present invention may take the form of an entirely hardware embodiment, an entirely software embodiment (including firmware, resident software, micro-code, etc.) or an embodiment combining software and hardware aspects, all of which may generally be referred to herein as a "circuit," "module," or "system." Furthermore, the present invention may take the form of a computer program product embodied in any tangible medium of expression having computer usable program code embodied in the medium.

Figure 1:
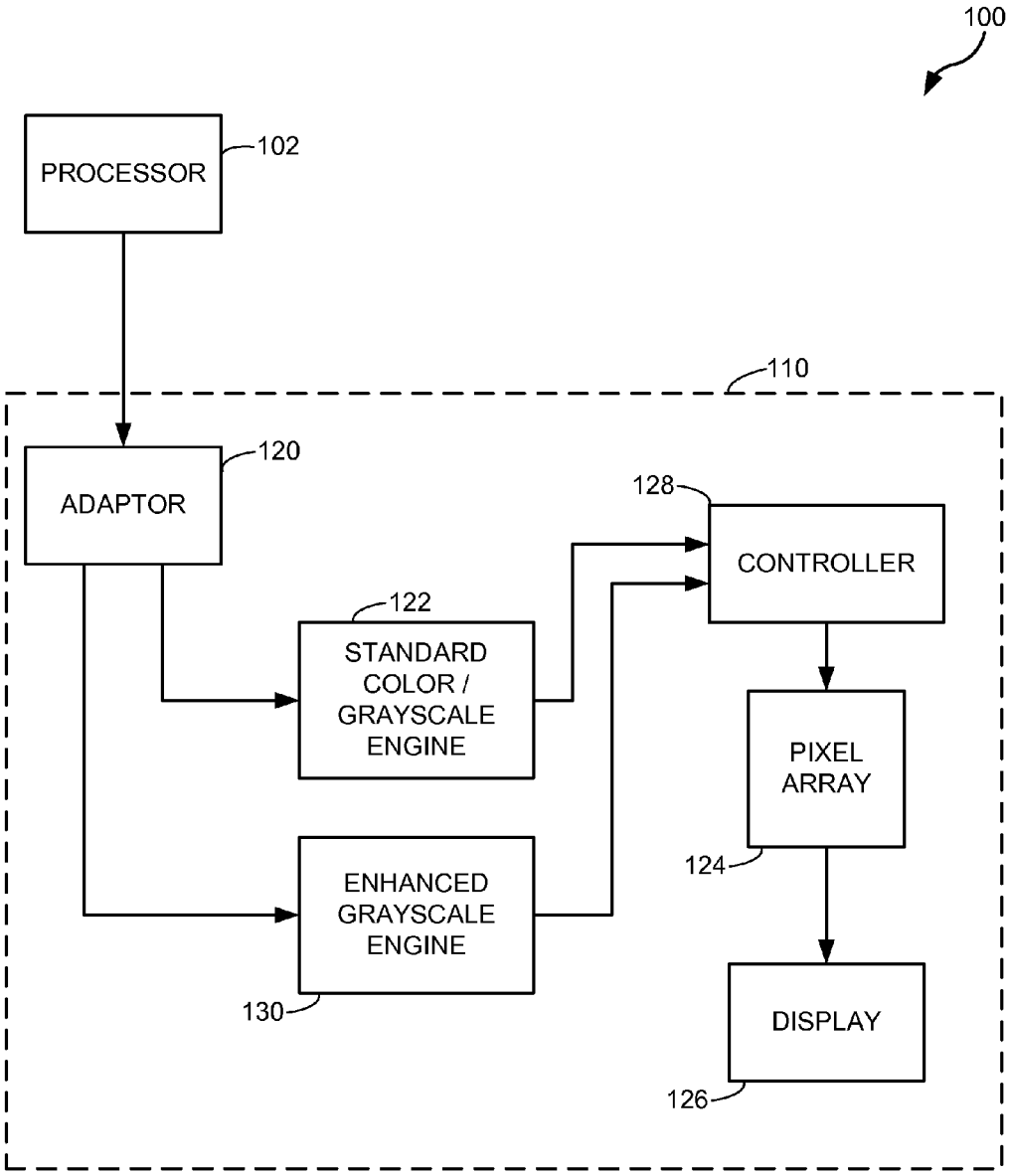
FIG. 1 illustrates a block diagram showing a system for enhanced monochromatic display in accordance with a preferred embodiment.

FIG. 1 is a high-level block diagram illustrating certain components of a system 100 for enhanced grayscale display. As used herein, "grayscale", means any monochromatic range of shades. For ease of illustration, the disclosed embodiments are described with respect to a gray "grayscale," a range of shades based on a base color of gray. One skilled in the art will understand that the disclosed embodiments can be converted to operate with any base color so as to produce a range of shades in that base color. For example, in one embodiment, a display output is configured as a red grayscale. As such, unless otherwise indicated, "grayscale" and "monochromatic" are used herein substantially interchangeably.

System 100 includes a processor 102 coupled to a display system 110. Generally, processor 102 is an otherwise conventional processor able to run applications and other processes that produce graphical output intended for display to a user. Generally, processor 102 generates signals and/or other communications conveying graphical information, collectively and/or individually, that are intended for use to generate images for display to a user. In one embodiment, processor 102 sends display information configured as conventional input signals able to communicate with an otherwise conventional display device, such as a computer monitor, for example. In one embodiment, as described in more detail below, processor 102 sends display information configured as an enhanced grayscale signal. In one embodiment, processor 102 sends display information configured as an enhanced grayscale signal and/or a conventional input signal.

Generally, in one embodiment, display system 110 receives signals/communications from processor 102, processes the signals, and displays images to a user, as described in more detail below. Display system 110 includes an adaptor 120. Generally, adaptor 120 is an otherwise conventional adaptor able to couple to and communicate with processor 102. In one embodiment, adaptor 120 is also able to identify standard input signals and enhanced grayscale signals. In one embodiment, as described in more detail below, adaptor 120 forwards received signals to one of a variety of components depending on the type of input signal. In one embodiment, adaptor 120 forwards received signals to both a standard display engine and an enhanced grayscale engine.

For example, in the illustrated embodiment, display system 110 includes a standard color/grayscale engine 122 and an enhanced grayscale engine 130. Enhanced grayscale engine 130 couples to adaptor 120 and an array of pixels, as described in more detail below. Generally, standard color/grayscale engine 122 is an otherwise conventional color/grayscale processor able to receive standard input signals and to generate standard display signals based on received standard input signals. In one embodiment, standard display signals are configured to set the bits of a pixel according to common practices.

For example, in the illustrated embodiment, engine 122 couples to a standard 8-bit RGB array 124 through a controller 128. In the illustrated embodiment, controller 128 is configured to select between input from engine 122 and engine 130, and to pass selected input to array 124, as described in more detail below. As described in more detail below, adaptor 120 and/or controller 128, can thereby be configured to display both enhanced grayscale images and standard (color or grayscale) images simultaneously on the same output display.

Generally, array 124 is an otherwise standard array of pixels, modified as described in more detail below. Thus, in the illustrated embodiment, array 124 is able to receive standard display signals from engine 122 and to set the physical elements corresponding to each pixel in the array. In the illustrated embodiment, the physical elements are shown as display 126. That is, in the illustrated embodiment, display 126 is an otherwise conventional array of physical elements configured to operate as pixels.

As such, one skilled in the art will understand that display 126 can be embodied in a variety of configurations. For example, typical modern digital displays now have essentially replaced analog CRT (Cathode-Ray Tube) displays. One skilled in the art will understand that while LCD (Liquid Crystal Display) monitors are the most common digital display technology on the market, but other examples include PDP (Plasma Display Panel), LED (Light Emitting Diodes), OLED (Organic LEDs), DLP (Digital Light Processing), LCoS (Liquid Crystal on Silicon), SED (Surface-conduction electron-Emitter Display), FED, (Field Emission Display), MEMS (Micro-electro-mechanical systems), laser systems, and many others.

Figure 2:
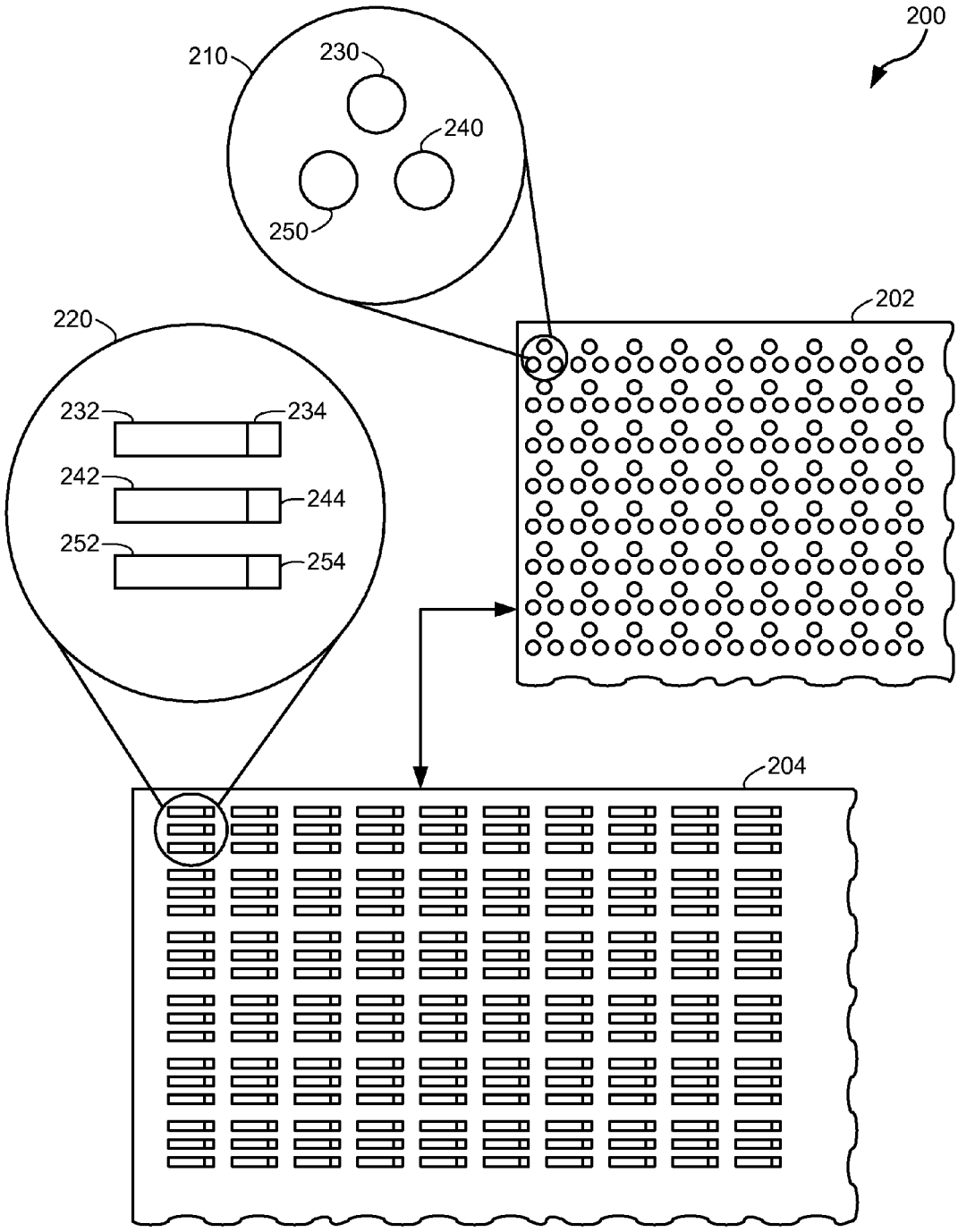
FIG. 2 illustrates a block diagram showing an exemplary pixel array in accordance with a preferred embodiment.

In one embodiment, regardless of the technology employed to produce light, each pixel in array 124 is comprised of three sub-pixels. For example, FIG. 2 shows an exemplary pixel array and output display in one embodiment. In the illustrated embodiment, system 200 includes an output display 202 coupled to a pixel array 204.

In the illustrated embodiment, output display 202 includes a plurality of physical elements (pixels) 210 arranged in a number of rows and columns. In the illustrated embodiment, each pixel 210 is a tri-color pixel having red, green, and blue sub-pixels. As described in more detail below, in one embodiment pixel 210 is an "RGB pixel." That is, in one embodiment, pixel 210 includes red sub-pixel 230, green sub-pixel 240, and blue sub-pixel 250. In the illustrated embodiment, pixel 210 includes red, green, and blue sub-pixels. One skilled in the art will understand that other suitable sub-pixel configurations can also be employed.

In the illustrated embodiment, output display 202 is in communication with pixel array 204. Generally, in one embodiment, pixel array 204 is configured as a data structure having entries that correspond to the physical pixels of output display 202. For example, in the illustrated embodiment, entry 220 (the top left entry) corresponds to pixel 210 (the top left pixel).

In the illustrated embodiment, entry 220 includes separate fields for each sub-pixel. Additionally, in the illustrated embodiment, each field in entry 220 includes color bits and luminance bits. In one embodiment, as described in more detail below, the color bits include private color bits and common color bits. In the illustrated embodiment, entry 220 includes color bits 232 and luminance bits 234 corresponding to sub-pixel 230; color bits 242 and luminance bits 244 corresponding to sub-pixel 240; and color bits 252 and luminance bits 254 corresponding to sub-pixel 250. One skilled in the art will understand that the particular values held in entry 220 determine the color/shade of the pixel as seen by the human eye.

That is, if the size and geometry of a tri-color pixel is sufficiently small, the typical human eye can no longer perceive discrete red, green, and blue sub-pixel colors. Instead, the human eye perceives the pixel color as the chromatic sum of the sub-pixels. One skilled in the art will understand that it is this fortunate characteristic of human vision that makes color displays practical. Broadly, display performance is frequently measured by how well the pixels are able to reproduce the color and luminance of the source pixel information, the desired output shade.

Generally, as used herein, "color" means a particular tint or shade. In one embodiment, colors are expressed as a plurality of bits. In one embodiment, colors are expressed as a plurality of bits, partitioned into sub-sections, where each sub-section corresponds to one of an element of a color model, such as RGB, XYZ, HSL/HSV, and/or CMYK, for example. Generally, as used herein, "shade" means a monochrome color tint distinguishable by the human eye from a similar monochrome color tint. In one embodiment, a "shade" is a "just noticeable difference" of one monochrome color tint to a nearby monochrome color tint.

As such, one skilled in the art will understand that, in one embodiment, output display 202 is a two-dimensional array of RGB pixels, forming the basic structure of a color display. In one embodiment, the complete arrangement of physical pixels, and/or their corresponding array entries, is referred to as a "frame". One skilled in the art will understand that typical digital displays can present a new frame of pixel information sixty times per second (60 Hz). A 60 Hz frame-rate is well above the frequency required to give the illusion of continuous motion to the human eye. For instance, the 35 mm projectors used in typical motion picture theaters have a frame-rate of only 24 Hz.

Generally, output display 202, as well as many conventional digital displays, is configured to receive pixel information in a binary format that is discrete in both time and amplitude. One skilled in the art will understand that digital transmission systems are typically able to deliver information noise-free without information loss. However, in some cases, the nature of conveying pixel information via ordinary digital transportation requires the pixel values to be quantized. Accordingly, in many systems, there are a finite number of discrete configurations (color and luminance) available for each sub-pixel color.

In one embodiment, in a configuration for standard display, pixel 210 is an 8-bit-per-channel RGB pixel. In one embodiment, entry 220 assigns 8 bits (entries 232, 234) red sub-pixel 230, assigns 8 bits (entries 242, 244) to green sub-pixel 240, and assigns 8 bits (entries 252, 254) to blue sub-pixel 250. So configured, display 202 is a "24-bit display," with red, green and blue sub-pixels that can produce 256 luminance steps each, with digital values in the range of 0 to 255. Generally, in one embodiment, display 202 energizes (or otherwise engages) the physical pixels 210 according to the values assigned in array 204. As described in more detail below, one skilled in the art will understand that typical 8-bit-per-channel RBG displays can only generate 256 grayscale shades for monochrome images.

Figure 3:
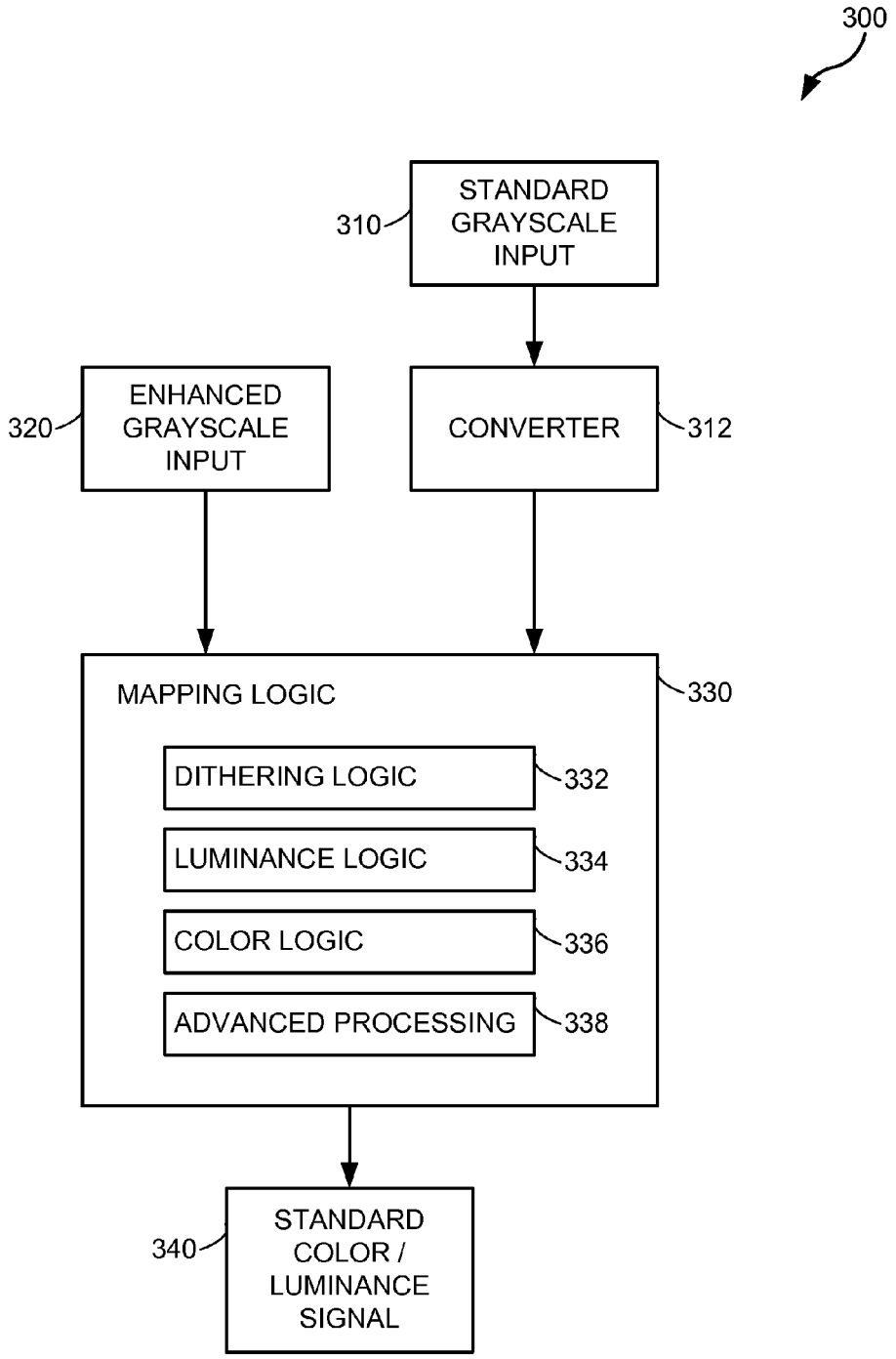
FIG. 3 illustrates a block diagram showing a system for enhanced monochromatic display in accordance with a preferred embodiment.

FIG. 3 illustrates a system 300 for providing the values in array 204. In one embodiment, system 300 is an enhanced grayscale engine 130 of FIG. 1. In an alternate embodiment, system 300 can be adapted to operate in a variety of environments, as one skilled in the art will understand. Broadly, in one embodiment, as described in more detail below, a mapping logic 330 generates a standard-format color/luminance signal 340 based on received input. In the illustrated embodiment, system 300 includes a converter 312 configured to receive standard grayscale input 310.

Generally, standard grayscale input 310 is configured to generate output signals that employ variations in luminance to provide a limited range of monochromatic shades. Generally, luminance is an indicator of how bright an object appears to a human observer, independent of its color. As described in more detail below, converter 312 is configured to convert standard grayscale input 310 into enhanced grayscale input 320. Generally, enhanced grayscale input 320 is configured to describe an enhanced range of monochromatic shades.

As described in more detail below, in one embodiment, mapping logic 330 receives enhanced grayscale input 320 (and/or standard grayscale input 310 converted to enhanced grayscale input by converter 312) and generates an output signal based on the received input. Specifically, in one embodiment, mapping logic generates standard color/luminance signal 340. In one embodiment, signal 340 is configured to convey display information to a standard display.

For example, as described above, in one embodiment, display 202 receives input from array 204. In one embodiment, signal 340 is configured to set the entries of array 204. In an alternate embodiment, signal 340 is configured for display 202 to receive directly.

Generally, in one embodiment, mapping logic 330 includes dithering logic 332, luminance logic 334, color logic 336, and advanced processing logic 338. As described in more detail below, in one embodiment, each logic module performs particular functions that contribute to the presentation of an enhanced grayscale image on a standard-format output device.

In the illustrated embodiment, mapping logic 330 includes dithering logic 332. Generally, dithering logic 332 is configured to determine appropriate intermediate shades based on the desired output shade indicated in the enhance grayscale input. One skilled in the art will understand that dithering is a well-known and practiced method of extending the perceived color depth of a given digital RGB display interface, by leveraging human vision to average the pixel values over multiple frames. For example, one skilled in the art will understand that, generally, doubling the number of averaged frames doubles the color depth, which thereby doubles the available shades that can be displayed. Additionally, in one embodiment, dithering logic 332 limits dithering to two-frame averaging. So configured, the resultant dithered frames are usually undetectable to the typical human observer. In an alternate embodiment, dithering logic 332 is configured to employ a varying number of frames, including and above two-frame dithering.

In an exemplary two-frame dithering embodiment, a given pixel will rapidly alternate between two values (shades) giving the illusion to a human observer of displaying a value (shade) in between the two shades actually displayed. In one embodiment, for a display driven with a frame-rate of 60 Hz, two-frame averaging results in a flicker rate of 30 Hz, which is above the threshold of human vision. However, in some cases, extending dithering to four-frame averaging yields a 15 Hz flicker rate, which can be detected by human observers. As such, in one embodiment, dithering logic 332 limits dithering to two-frame dithering.

In the illustrated embodiment, mapping logic 330 also includes luminance logic 334. Generally, in one embodiment, luminance logic 334 is configured to perform luminance-mixing. One skilled in the art will understand that luminance-mixing the primary colors, red, green and blue in different ratios can produce a large number of perceived colors, where color is defined by a specific pairing of a hue and luminance value. As described above, a color implies the convergence of a specific hue and luminance level. As such, one skilled in the art will understand that any arbitrary combination of sub-pixel color values results in luminance-mixing of those sub-pixel colors, yielding a specific perceived hue and luminance. Generally, in one embodiment, the number of possible luminance steps (and therefore perceived colors) is constrained by the number of digital bits assigned to each sub-pixel color.

Additionally, human vision limitations also tend to constrain the operational parameters of display systems in general. For example, for humans with normal color vision to perceive a shade of gray, the RGB luminance ratio must be very close to $L_R=0.30L_T$, $L_G=0.59L_T$, and $L_B=0.11L_T$, where $L_T$ is total luminance and $L_{R,G,B}$ is the luminance of each respective primary color (or sub-pixel). In some systems, the above ratio is referred to as "white balance."

One skilled in the art will understand that some conventional digital displays are configured with a fixed "white balance" ratio in order to simplify interfacing to the external world. For example, driving a conventional 8-bit-per-channel tri-color display (with a fixed white balance), with identical R, G, and B digital values produces a (gray) grayscale pixel, because the display automatically applies the primary color luminance weighting described above. As such, the number of grayscale shades available to conventional displays is limited to 256, effectively making the conventional display an 8-bit grayscale display (when driven with conventional 8-bit RGB channels). As described in more detail below, the disclosed embodiments extend the available grayscale shades of a conventional 8-bit display to the equivalent of an 11-bit grayscale display, without requiring hardware modifications of the conventional display.

In the illustrated embodiment, mapping logic 330 also includes color logic 336. Generally, in one embodiment, color logic 336 is configured to identify and process color information as encoded in the enhanced grayscale input. In one embodiment, as described in more detail below, color logic 336 is configured to select an output color from a plurality of colors based on the enhanced grayscale input. In one embodiment, described in more detail below, color logic 336 is configured to select an output color based on a plurality of bits of the enhanced grayscale input. Generally, in one embodiment, color logic 336 identifies the desired output color/shade indicated in the enhanced grayscale input while dithering logic 332 selects appropriate intermediate shades to produce the desired output color/shade.

In the illustrated embodiment, mapping logic 330 also includes advanced processing module 338. Generally, advanced processing module 338 is configured to perform various post processing and display enhancement techniques. In one embodiment, advanced processing module 338 is configured to perform decode verification. For example, in one embodiment, advanced processing module 338 is configured to store a pixel history and to perform verification on the pixel history to identify standard input and/or enhanced grayscale inputs that have been misidentified.

As described above, mapping logic 330 generates a standard color/luminance signal 340 based on the received enhanced grayscale input. In one embodiment, signal 340 is configured to conform to the input signal requirements of a standard output device. In one embodiment, signal 340 is configured to conform to the input signal requirements of a standard 8-bit-per-channel RGB display.

One skilled in the art will understand that conventional color displays typically rely on the chromatic and temporal characteristics of human vision to create in a display the illusion of a large range of colors and fluid motion. Generally, one skilled in the art will understand that humans have much higher spatial luminance (brightness) resolution than spatial color resolution. This feature of human vision is well known and has been leveraged in broadcast television for the purpose of limiting the bandwidth needed to transmit and store video. For example, conventional DVDs are typically encoded in such a way that adjacent pixels share the same color, but have distinct luminance values. However, conventional methods are subject to significant drawbacks, which are overcome by the disclosed embodiments.

Figure 4:
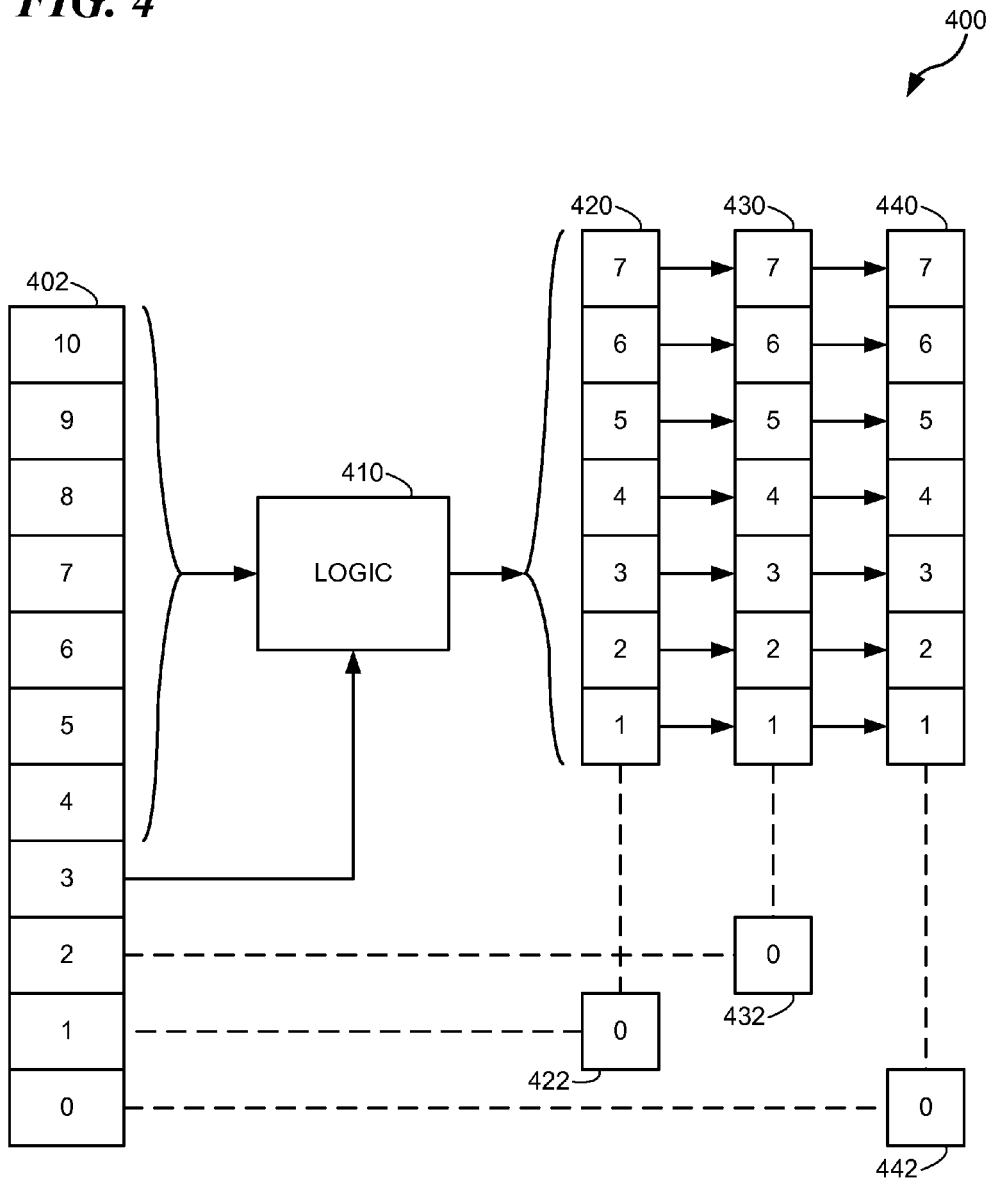
FIG. 4 illustrates a block diagram showing a portion of a grayscale engine in accordance with a preferred embodiment.

Specifically, in one embodiment, system 300 processes received enhanced grayscale input as described in more detail with respect to FIG. 4. Generally, FIG. 4 illustrates an exemplary bit mapping as processed by mapping logic 330 of FIG. 3. Broadly, system 400 illustrates a mapping of enhanced grayscale input 402 to sub-pixel array entries 420, 430, and 440, as described in more detail below.

Very broadly, in one embodiment, system 400 illustrates a combined Least-Significant Bit (LSB) demultiplexing and dithering to extend the grayscale of a given digital display by a factor of eight. In one embodiment, the luminance contributed by each of the RGB sub-pixel colors follows an approximately binary trend ($L_G \approx 2L_R$ and $L_R \approx 2L_B$). In one embodiment, system 400 assumes a linear luminance transfer function, wherein input pixel data values are directly proportional to the luminance of the respective pixels. In one embodiment, luminance is also normalized to the binary data value.

In the illustrated embodiment, input 410 includes 11 bits. In one embodiment, bits 0-2 and 4-10 are "shade bits" and bit 3 is a "select bit". In one embodiment, bits 0-2 and 4-10 are "shade bits" and bit 3 is both a "shade bit" and a "select bit". In one embodiment, bits 0-2 are "shade bits" contributing to luminance, bits 4-10 are "shade bits", and bit 3 is a "select bit". In one embodiment, bits 0-2 and 4-10 are "direct shade bits," mapped to a particular sub-pixel bit, and bit 3 is an indirect "shade bit," which influences the sub-pixel bits based on bits 4-10. So configured, the disclosed embodiments can, in one embodiment, synthesize 2048 monochrome shades (equivalent to 11-bit grayscale) on a standard 8-bit-per-channel RGB display, as described in more detail below.

In the illustrated embodiment, system 400 includes three sub-pixels 420, 430, and 440. Generally, in one embodiment, sub-pixels 420, 430, and 440 together correspond to entries 220 as described above. In one embodiment, each sub-pixel 420, 430, and 440 includes a plurality of common color bits and a plurality of private color bits. In the illustrated embodiment, each sub-pixel 420, 430, and 440 includes seven common color bits (bits 1-7) and one private color bit (bit 0). Generally, each sub-pixel can be configured with a variety of numbers of common color bits and/or private bits. Generally, however, one skilled in the art will understand that typical 8-bit-per-channel RGB displays are configured with 8-bit entries for each RGB sub-pixel. As such, in one embodiment, sub-pixels 420, 430, and 440 are configured to correspond to conventional RGB channels.

In the illustrated embodiment, system 400 maps the top (higher-order) seven bits of the RBG sub-pixels 430, 430, and 440 to the same value, based on the top seven bits (bits 4-10) of input 402. Additionally, in the illustrated embodiment, system 400 maps bits 0-2, individually, to each of the private color bits of the sub-pixels. Specifically, in the illustrated embodiment, system 400 maps bit 1 to bit 0 (422) of sub-pixel 420, bit 2 to bit 0 (432) of sub-pixel 430, and bit 0 to bit 0 (442) of sub-pixel 440. Additionally, in one embodiment, system 400 maps bits 0-2 to the low order bits of the sub-pixels according to their luminance significance.

In the illustrated embodiment, system 400 employs bit 3 as a "select bit", which is an input to logic 410. As illustrated, system 400 also provides the upper seven bits of input 402 (the "shade bits") as an input to logic 410. As described in more detail below, in one embodiment logic 410 employs the shade bits and the select bit to configure the common color bits of sub-pixels 420, 430, and 440.

For example, in one embodiment, as described above, system 400 employs two-frame dithering and uses the select bit (bit 3) to select between two intermediate shades. For example, in one embodiment, when bit 3=0, logic 410 copies the values of bits 4-10 to the common color bits of the sub-pixels. Similarly, in one embodiment, when bit 3=1, logic 410 copies the values of bits 4-10 to the common color bits for even-numbered frames. In one embodiment, when bit 3=1, logic 410 copies the values of bits 4-10, plus 1, to the common color bits for odd-numbered frames. Thus, in one embodiment, system 400 can be configured to fit an 11-bit value of pixel information into three 8-bit sub pixels. Thus, the disclosed embodiments can therefore present 2^11 different monochrome shades on systems that ordinarily can only display 2^8 different monochrome shades using conventional approaches.

One skilled in the art will understand that, in some embodiments, system 400 can yield very slight color shifts. However, in such embodiments, these color shifts will be masked by complimentary color shifts of nearby pixels, leaving only the differences in luminance perceptible. As such, in some embodiments, the disclosed embodiments realize enhanced grayscale images without additional processing to neutralize color shifts through the use of nearby pixels. In such cases, generally, unintended color shifts are so small as to be nearly invisible to normal human vision. Additionally, as described above, in some embodiments, advanced processing module 338 can be configured to normalize and or otherwise process the resultant output shades to improve performance, visibility, and/or other suitable characteristics of the output displayed to the user.

Figure 5:
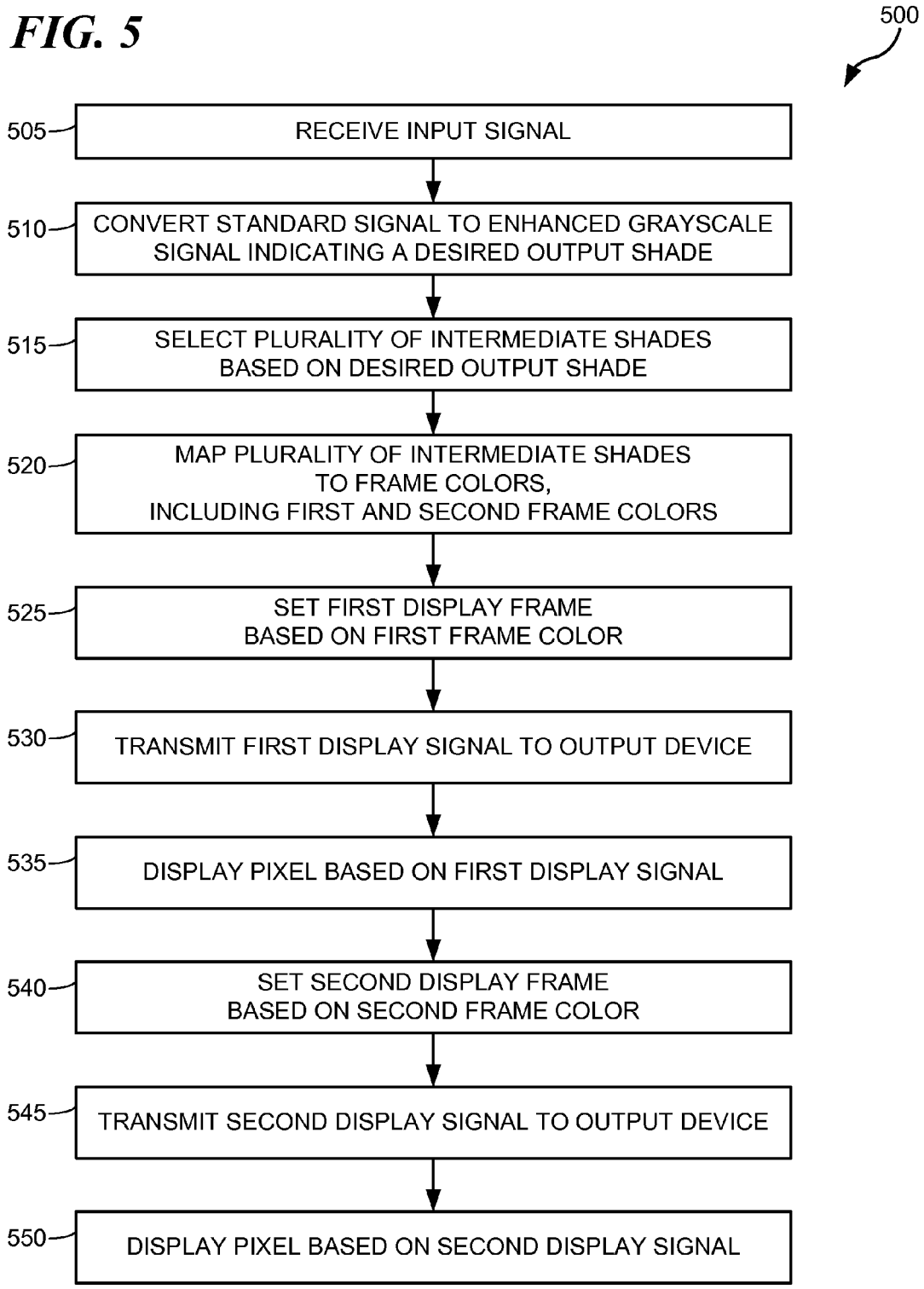
FIG. 5 illustrates a high-level flow diagram depicting logical operational steps of an enhanced grayscale display method, which can be implemented in accordance with a preferred embodiment.

FIG. 5 illustrates one embodiment of a method for enhanced monochromatic display. Specifically, FIG. 5 illustrates a high-level flow chart 500 that depicts logical operational steps performed by, for example, system 300 of FIG. 3, and/or system 400 of FIG. 4, which may be implemented in accordance with a preferred embodiment. Generally, mapping module 330 performs the steps of the method, unless indicated otherwise.

As indicated at block 505, the process begins, wherein system 300 receives an input signal. Next, as indicated at block 510, converter 312 converts a received standard input signal into an enhanced grayscale signal that indicates a desired output shade. Next, as indicated at block 515, mapping logic 330 selects a plurality of intermediate shades based on the desired output shade.

Next, as indicated at block 520, mapping logic 330 maps the plurality of intermediate shades to frame colors, including first and second frame colors. Next, as indicated at block 525, mapping logic 330 sets a first display frame based on the first frame color. Next, as indicated at block 530, mapping logic 330 transmits a first display signal to an output device. Next, as indicated at block 535, the output device displays the pixel to a user, based on the first display frame.

Next, as indicated at block 540, mapping logic 330 sets a second display frame based on the second frame color. Next, as indicated at block 545, mapping logic 330 transmits a second display signal to the output device. Next, as indicated at block 550, the output device displays the pixel to a user, based on the second display frame, and the process ends.

Figure 6:
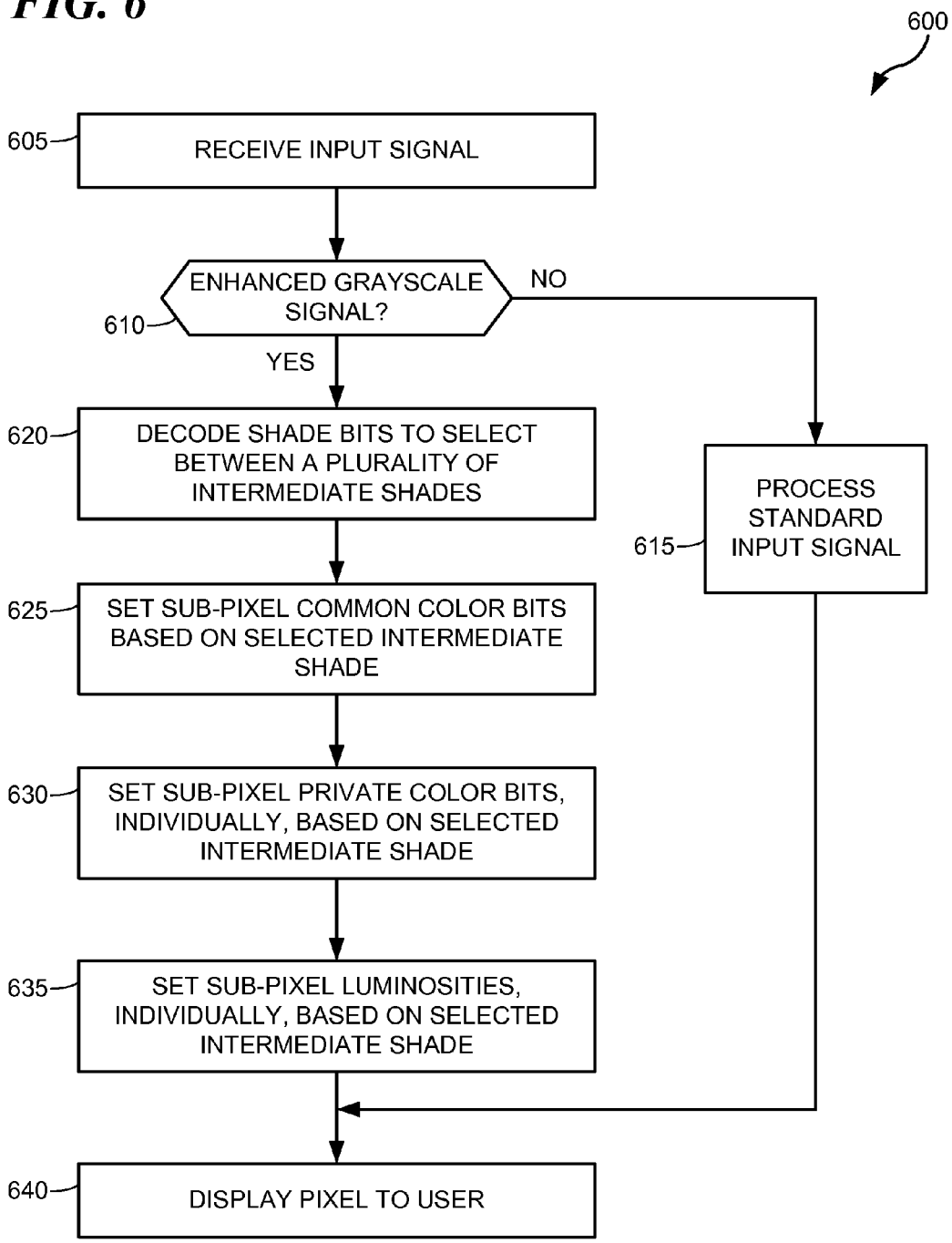
FIG. 6 illustrates a high-level flow diagram depicting logical operational steps of another enhanced grayscale display method, which can be implemented in accordance with a preferred embodiment.

FIG. 6 illustrates one embodiment of a method for enhanced monochromatic display. Specifically, FIG. 6 illustrates a high-level flow chart 600 that depicts logical operational steps performed by, for example, system 100 of FIG. 1, system 300 of FIG. 3, and/or system 400 of FIG. 4, which may be implemented in accordance with a preferred embodiment. Generally, mapping module 330 performs the steps of the method, unless indicated otherwise.

As indicated at block 605, the process begins, wherein system 300 receives an input signal. Next, as indicated at decisional block 610, the system determines whether the received input signal is an enhanced grayscale signal. For example, in one embodiment, adaptor 120 analyzes the received input signal to determine whether the received input signal is a standard input signal or an enhanced grayscale signal. If at decisional block 610 the input signal is not an enhanced grayscale signal, the process continues along the NO branch to block 615. As illustrated at block 615, system 100 processes the standard input signal normally and the process continues to block 640, wherein system 100 displays the pixel to the user.

If at decisional block 610 the input signal is an enhanced grayscale signal, the process continues along the YES branch to block 620. Next, as indicated at block 620, mapping logic 330 decodes the shade bits of the received input signal to select between a plurality of intermediate shades.

Next, as indicated at block 625, mapping logic 330 sets the sub-pixel common color bits based on the selected intermediate shade. Next, as indicated at block 630, mapping logic 330 sets the sub-pixel private color bits, individually, based on the selected intermediate shade. Next, as indicated at block 635, mapping logic 330 sets the sub-pixel luminosities, individually, based on the selected intermediate shade.

Next, as indicated at block 640, system 100 displays the pixel to the user and the process ends.

Accordingly, the disclosed embodiments provide numerous advantages over other methods and systems. For example, the disclosed embodiments provide an enhanced grayscale display that leverages the characteristics of human vision to extend the number of perceived shades of monochrome gray that a given digital color display can produce by a factor of eight. For example, in one embodiment, the disclosed embodiments increase number of shades of gray that a standard 8-bit-per-channel tri-color LCD panel can display from 256 (8-bit) to 2048 (11-bit).

Additionally, the disclosed embodiments can be configured to exceed current industry standard display requirements. For example, many physicians use special displays for diagnostic purposes. One such special-purpose display produces grayscale images instead of color for analyzing chest X-Rays, CT scans, and similar high-dynamic-range monochromatic images. One skilled in the art will understand that, in the case of viewing a chest X-Ray, it is important that the X-Ray image viewed on the medical display conveys as much diagnostic information as possible, and at least as much diagnostic information as viewing the X-Ray negative itself against a light-box.

One skilled in the art will understand that Digital Imaging and Communications in Medicine (DICOM) is a standard for handling, storing, printing, and transmitting information in medical imaging. The National Electrical Manufacturers Association (NEMA) created the DICOM standard in part to insure that diagnostic images appear the same, whether viewed via print, film, or electronic display.

Additionally, one skilled in the art will understand that DICOM specification (PS 3.14-2009) "Part 14: Grayscale Standard Display Function" recommends that a medical grayscale display produce a minimum of 1024 JND ("Just Noticeable Difference") shades of gray. As described above, typical DICOM monitor manufacturers use expensive custom grayscale-only display modules that are capable of generating at least 1024 shades of gray. However, such monitors, known as 10-bit DICOM displays, are typically very costly and nevertheless restrict the maximum number of monochromatic shades to 2^10 (i.e., as per the number of binary bits used to describe the desired output shade. But the disclosed embodiments provide, in one embodiment, a 3-bit extension of the color/shade range without also introducing higher costs, power usage, or requiring a custom display device.

Moreover the disclosed embodiments also offer improvements over conventional dithering techniques. For example, one skilled in the art will understand that conventional dithering techniques are ordinarily limited to two-frame dithering because, as described above, additional frame averaging above two frames causes a flicker rate detectable by a human observer. As such, conventional dithering techniques would limit grayscale enhancement to doubling the shades of gray from 256 to 512 shades in a typical 8-bit-per-channel RGB color display. But the disclosed embodiments can be configured to provide over 2000 monochromatic shades without also requiring more than two-frame dithering. As such, the disclosed embodiments offer greater performance over prior systems and methods.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

One skilled in the art will appreciate that variations of the above-disclosed and other features and functions, or alternatives thereof, may be desirably combined into many other different systems or applications. Additionally, various presently unforeseen or unanticipated alternatives, modifications, variations or improvements therein may be subsequently made by those skilled in the art, which are also intended to be encompassed by the following claims.

What is claimed is:

1. A method for generating a desired output shade in a pixel for display to a user, comprising:

receiving a desired output shade of a pixel for display to a user;

the pixel having a first sub-pixel, a second sub-pixel, and a third sub-pixel, each of the first sub-pixel, second sub-pixel, and third sub-pixel having associated a luminosity, a plurality of private color bits, and a plurality of common color bits;

selecting a plurality of intermediate shades based on the desired output shade;

mapping the plurality of intermediate shades to a plurality of frame colors, the plurality of frame colors including a first frame color and a second frame color;

setting a first display frame, wherein setting the first display frame comprises setting the luminosity, private color bits, and common color bits of each of the first sub-pixel, second sub-pixel, and third sub-pixel based on the first frame color;

setting a second display frame, wherein setting the second display frame comprises setting the luminosity, private color bits, and common color bits of each of the first sub-pixel, second sub-pixel, and third sub-pixel based on the second frame color;

sending a first display signal to an output device, the first display signal being based on the first display frame, and the output device being able to display the pixel to the user based on the first display signal; and sending a second display signal to an output device, the second display signal being based on the second display frame, and the output device being able to display the pixel to the user based on the second display signal, wherein the output device is an 8-bit-per-channel Red/Blue/Green color monitor and the desired output shade comprises 11 bits.

2. The method of claim 1, wherein:

the desired output shade comprises a plurality of select bits; and mapping the plurality of intermediate shades to a plurality of frame colors includes selecting between a first frame color and a second frame color based at least one of on the plurality select bits.

3. The method of claim 1, wherein:

the desired output shade comprises a plurality of shade bits and a select bit; and wherein setting the luminosity, private color bit, and common color bits of each of the first sub-pixel, second sub-pixel, and third sub-pixel based on the first frame color comprises:

setting the common color bits of the first sub-pixel, second sub-pixel, and third sub-pixel to a first value, based on the plurality of shade bits and the select bit;

independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

4. The method of claim 3, further comprising:

wherein setting the luminosity, private color bit, and common color bits of each of the first sub-pixel, second sub-pixel, and third sub-pixel based on the second frame color comprises:

setting the common color bits of the first sub-pixel, second sub-pixel, and third sub-pixel to a second value, based on the plurality of shade bits and the select bit;

independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

5. The method of claim 1, wherein the desired output shade is a monochromatic shade.

6. The method of claim 1, wherein each of the plurality of common color bits comprise 7 bits and each of the plurality of private color bits comprise 1 bit.

7. The method of claim 1, wherein the desired output shade is one of a plurality of output shades, the plurality of output shades including at least 1024 monochromatic output shades.

8. A system for generating a desired output shade in a pixel for display to a user, comprising:

a grayscale engine able to receive a desired monochromatic output shade of a pixel for display to a user;

the pixel having a first sub-pixel, a second sub-pixel, and a third sub-pixel, each of the first sub-pixel, second sub-pixel, and third sub-pixel having associated a luminosity, a plurality of private color bits, and a plurality of common color bits;

the grayscale engine further able to select a plurality of intermediate shades based on the desired output monochromatic shade;

the grayscale engine further able to map the plurality of intermediate shades to a plurality of frame colors, the plurality of frame colors including a first frame color and a second frame color;

the grayscale engine further able to set a first display frame, wherein setting the first display frame comprises setting the luminosity, private color bits, and common color bits of each of the first sub-pixel, second sub-pixel, and third sub-pixel based on the first frame color;

the grayscale engine further able to set a second display frame, wherein setting the second display frame comprises setting the luminosity, private color bits, and common color bits of each of the first sub-pixel, second sub-pixel, and third sub-pixel based on the second frame color; and an output device coupled to the grayscale engine, the output device being able to display the pixel to the user based on the first display frame, wherein the output device is an 8-bit-per-channel Red/Blue/Green color monitor and the desired output shade comprises 11 bits; and the output device further able to display the pixel to the user based on the second display frame.

9. The system of claim 8, wherein:

the desired output shade comprises a plurality of select bits; and mapping the plurality of intermediate shades to a plurality of frame colors includes selecting between a first frame color and a second frame color based at least one of on the plurality select bits.

10. The system of claim 8, wherein:

the desired monochromatic output shade comprises a plurality of shade bits and a select bit; and wherein setting the luminosity, private color bit, and common color bits of each of the first sub-pixel, second sub-pixel, and third sub-pixel based on the first frame color comprises:

setting the common color bits of the first sub-pixel, second sub-pixel, and third sub-pixel to a first value, based on the plurality of shade bits and the select bit;

independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

11. The system of claim 10, further comprising:

wherein setting the luminosity, private color bit, and common color bits of each of the first sub-pixel, second sub-pixel, and third sub-pixel based on the second frame color comprises:

setting the common color bits of the first sub-pixel, second sub-pixel, and third sub-pixel to a second value, based on the plurality of shade bits and the select bit;

independently setting the private color bits of the first sub-pixel, second sub-pixel, and third sub-pixel based on the plurality of shade bits, not including the select bit; and independently setting the luminosity of the first sub-pixel, second sub-pixel, and third sub-pixel based on the plurality of shade bits.

12. The system of claim 8, wherein the desired monochromatic output shade is a grayscale shade.

13. The system of claim 8, wherein the desired output shade is one of a plurality of output shades, the plurality of output shades including at least 1024 output shades.

14. A device for displaying color and monochrome images to a user, the device comprising:

an adaptor able to receive an input signal;

the adaptor further able to determine whether the received input signal is an enhanced monochromatic signal;

the adaptor further able to transmit a received enhanced monochromatic signal to a grayscale engine;

the received monochromatic signal having a plurality of shade bits and a plurality of select bits;

the grayscale engine able to:

decode the plurality of shade bits and the plurality of select bits to select an intermediate shade of a plurality of intermediate shades;

set a plurality of sub-pixel common color bits of a pixel based on the selected intermediate shade;

set a plurality of private color bits of the pixel based on the selected intermediate shade;

set a plurality of luminosities of the pixel based on the selected intermediate shade;

set a first display frame comprising at least one of the plurality of luminosities, at least one of the plurality of private color bits, and at least one of the sub-pixel common color bits;

set a second display frame comprising at least one of the plurality of luminosities, at least one of the plurality of private color bits, and at least one of the sub-pixel common color bits; and communicate the first and second display frames to an output device, wherein the output device is an 8-bit-per-channel Red/Blue/Green color monitor and the enhanced monochromatic signal comprises 11 bits; and the output device being coupled to the grayscale engine, the output device being able to display the pixel to a user based on the first and second display frames.

15. The device of claim 14, wherein each of the plurality of sub-pixel common color bits comprise 7 bits and each of the plurality of private color bits comprise 1 bit.

16. The device of claim 14, wherein the desired output shade is one of a plurality of output shades, the plurality of output shades including at least 1024 output shades.

* * * * *

UNITED STATES PATENT AND TRADEMARK OFFICE

CERTIFICATE OF CORRECTION

PATENT NO. : 8,531,476 B1
APPLICATION NO. : 12/877095
DATED : September 10, 2013
INVENTOR(S) : Jiang et al.

It is certified that error appears in the above-identified patent and that said Letters Patent is hereby corrected as shown below:

In the Specification:

Column 2, Lines 40-41, delete the portion of text reading "Red/Blue/Greed" and replace with --Red/Blue/Green--.

Column 2, Line 45, delete the portion of text reading "Red/Blue/Greed" and replace with --Red/Blue/Green--.

Column 3, Line 66, delete the portion of text reading "Red/Blue/Greed" and replace with --Red/Blue/Green--.

Column 4, Line 4, delete the portion of text reading "Red/Blue/Greed" and replace with --Red/Blue/Green--.

Signed and Sealed this
Twenty-ninth Day of October, 2013

Teresa Stanek Rea

Teresa Stanek Rea
*Deputy Director of the United States Patent and Trademark Office*